US007404452B2

(12) United States Patent
Malkin et al.

(10) Patent No.: US 7,404,452 B2
(45) Date of Patent: Jul. 29, 2008

(54) PERCUSSION POWER TOOL APPARATUS

(75) Inventors: Anthony A. Malkin, Staffordshire (GB); Ilya Sokolov, Leicestershire (GB); Vladimir Babitsky, Leicestershire (GB)

(73) Assignee: J.C. Bamford Excavators Limited, Uttoxeter, Staffordshire (GB)

( * ) Notice: Subject to any disclaimer, the term of this patent is extended or adjusted under 35 U.S.C. 154(b) by 0 days.

(21) Appl. No.: 11/318,667

(22) Filed: Dec. 21, 2005

(65) Prior Publication Data

US 2006/0157263 A1 Jul. 20, 2006

(30) Foreign Application Priority Data

Dec. 24, 2004 (GB) ..... 0428348.7

(51) Int. Cl.
*B25D 17/00* (2006.01)

(52) U.S. Cl. ..... 173/162.2; 173/162.1; 173/212; 173/208; 16/431

(58) Field of Classification Search ..... 173/162.2, 173/162.1, 170, 210, 212, 207, 208, 206; 16/431
See application file for complete search history.

(56) References Cited

U.S. PATENT DOCUMENTS 3,107,083 A * 10/1963 Pewthers ..... 173/203
3,332,504 A * 7/1967 Lowery ..... 173/162.2
3,451,492 A * 6/1969 Blomberg et al. ..... 173/162.2
4,282,938 A * 8/1981 Minamidate ..... 173/162.2
4,576,241 A * 3/1986 Emonet ..... 173/162.2
4,673,043 A * 6/1987 Greppmair ..... 173/162.2
4,800,965 A * 1/1989 Keller ..... 173/162.2
5,052,499 A * 10/1991 Dobry et al. ..... 173/162.1
5,095,600 A * 3/1992 Allan ..... 29/81.16
5,921,327 A * 7/1999 Henriksson et al. ..... 173/210
5,944,120 A * 8/1999 Barden ..... 173/212
5,947,211 A * 9/1999 Jakobsson ..... 173/210
6,050,345 A * 4/2000 Jarvinen et al. ..... 173/31

(Continued)

FOREIGN PATENT DOCUMENTS

GB 2 098 121 11/1982

(Continued)

OTHER PUBLICATIONS

International Search Report for GB0428348.7 dated Mar. 23, 2005.

(Continued)

*Primary Examiner*—Scott A. Smith
(74) *Attorney, Agent, or Firm*—Marshall, Gerstein & Borun LLP

(57) ABSTRACT

A percussion power tool apparatus includes a body relative to which an impacting tool is moved to effect an impacting operation, the apparatus further including an operating member by means of which an operating load is applied in an operating direction to the apparatus, a support structure for the operating member including a piston received in a cylinder, the operating load acting to move the piston inwardly of the cylinder whilst such movement is resisted by fluid pressure in the cylinder at one side of the piston, relative movement between the piston and the cylinder being permitted in response to vibrations arising in the body and/or impacting tool, by controlling fluid flow between the one side of the piston and a pressurised fluid support system.

17 Claims, 4 Drawing Sheets

U.S. PATENT DOCUMENTS

| | | | | |
|---|---|---|---|---|
| 6,076,616 | A * | 6/2000 | Kramp et al. | 173/162.2 |
| 6,421,880 | B1 * | 7/2002 | Prajapati et al. | 16/431 |
| 6,796,747 | B1 * | 9/2004 | Vreeland | 405/302.7 |
| 6,799,643 | B2 * | 10/2004 | Voulkidis et al. | 173/170 |

FOREIGN PATENT DOCUMENTS

| | | |
|---|---|---|
| WO | WO 93/06972 | 4/1993 |
| WO | WO-2005/007351 A1 | 1/2005 |

OTHER PUBLICATIONS

International Search Report in International Application No. GB0526355.3, dated Apr. 20, 2006.

* cited by examiner

PERCUSSION POWER TOOL APPARATUS

BACKGROUND TO THE INVENTION

This invention relates to a percussion power tool apparatus which includes a body mounting an impacting tool, the tool being moved outwardly of the body e.g. by an impacting piston impacting the tool. One such percussion power tool apparatus is known as a breaker and is used to break concrete, paving or another structure or particle e.g. the ground. In a breaker, the impacting tool may be impacted by the impacting piston several times each second, and in one type of breaker apparatus, the impacting piston is moved by fluid pressure acting within a cylinder containing the impacting piston. The impacting tool, upon striking the ground or another structure or particle to be broken, reacts by moving back inwardly of the body.

The operating cycle of the percussion power tool apparatus therefore gives rise to various vibrations, some of which are transmitted via the impacting tool to effect a breaking or other impacting operation, to break the ground or other structure or particles.

DESCRIPTION OF THE PRIOR ART

A breaker type percussion power tool typically includes one or a pair of operating members i.e. a handle or handles, by means of which an operator may apply an operating load to the apparatus in an operating direction, and generally manipulate the apparatus. It will be appreciated that in use, at least some vibrations arising from the operating cycle tend to be transmitted via the handle or handles to the operator's hands, which vibrations can, particularly where an operator operates the apparatus for a prolonged period, cause vibration injury, such as for example only, the effect known as "white finger" when an operator may at least partially loose some sensation in his hands and/or arms.

It is desirable to isolate the operator's hands from the vibrations arising, or at least to reduce the transmission of vibrations via the handle structure, to the operator's hands.

More broadly, in a percussion tool apparatus which may be part of a larger mechanism, e.g. a tunnel boring apparatus, it is desirable to isolate the percussion tool apparatus from the remainder of the mechanism, and particularly from the means by which a load may be applied to the apparatus via an operating members in an operating direction, or at least to reduce the transmission of vibrations via the operating member.

It has been proposed for a breaker apparatus, for the handle or handles to be spring mounted, the springs being provided to damp movements of the handles which occur in response to vibrations. Such prior proposals have not proved to be overly effective in reducing the transmission of vibrations to the operator, largely because the springs employed necessarily have to act over a small distance and thus present a significant stiffness, so that the operator may apply the load in the operating direction using the handle or handles. If a very low stiffness springs were used which could act over a greater distance, the transmission of vibrations may more effectively be prevented, but long springs are difficult physically to accommodate particularly in a hand operated breaker apparatus, and in any event, long springs tend to be unstable and would require stabilisation.

SUMMARY OF THE INVENTION

According to a first aspect of the invention we provide a percussion power tool apparatus including a body relative to which an impacting tool is moved to effect an impacting operation, the apparatus further including an operating member by means of which an operating load is applied in an operating direction to the apparatus, a support structure for the operating member including a piston received in a cylinder, the operating load acting to move the piston inwardly of the cylinder whilst such movement is resisted by fluid pressure in the cylinder at one side of the piston, relative movement between the piston and the cylinder being permitted in response to vibrations arising in the body and/or impacting tool, by controlling fluid flow between the one side of the piston and a pressurised fluid support system.

By virtue of the present invention, the operating member may be more effectively isolated from vibrations arising in the body and/or impacting tool than in previously known percussion power tool apparatus.

Where the apparatus is a hand operated apparatus, such as a breaker apparatus, the operating member would be a handle structure with one or a pair of handles for examples, and the operator will be more effectively isolated from vibrations which may otherwise be transmitted via the handle structure, than with known breaker apparatus. Alternatively, where the apparatus is part of a mechanism in which the operating member is a mounting structure mounting the apparatus with respect to the remainder of the mechanism, the remainder of the mechanism will be more effectively isolated from potentially damaging vibrations which may otherwise be transmitted via the mounting structure, than with known percussion tool apparatus.

Parameters of the apparatus, and in particular fluid flow characteristics to and from the one side of the piston, may be optimised more effectively to reduce the transmission of vibrations to the operating member, and in the case of a breaker apparatus, without compromising the ability of an operator to apply the operating load and control the apparatus.

In a first arrangement, the pressurised fluid support system may include a fluid accumulator with which the one side of the piston communicates. Thus the pressure exerted on the fluid by the accumulator will control the flow of fluid both from and to the one side of the piston of the support structure as the piston and cylinder tend relatively to move in response to vibrations arising. The accumulator may typically be a chamber including a resilient member such as a diaphragm to which a gas pressure is applied, but another accumulator may instead be provided as required.

In a second arrangement, the pressure in the pressurised fluid support system may vary in accordance with the operating cycle of the percussion tool apparatus, so that fluid flow from and to the one side of the piston is controlled by the varying pressure in the pressurised fluid support system, in accordance with the operating cycle.

In another proposal, the pressurised fluid support system may include both a fluid accumulator to which the one side of the piston communicates, and the pressure in the pressurised fluid support system may vary with the operating cycle of the percussion tool apparatus.

In the latter two cases, where the percussion power tool apparatus is of the kind in which the impacting tool is moved outwardly of the body by being struck by an impacting piston moved by fluid pressure, the pressure of fluid at the one side of the piston of the operating member support structure may vary with the fluid pressure applied to move the impacting piston.

For example, there may be a feed line for pressurised fluid from a pressurised fluid supply line of the operating system which provides power to move the impacting piston, to the pressurised fluid support system, the feed line including a throttle to restrict fluid flow between the pressurised fluid supply line and the pressurised fluid support system.

The throttle may provide for set throttling only, or may be controllable to vary the extent of throttling depending upon one or more sensed parameters.

In each case, the setting of the throttle may permit the controlled flow of pressurised fluid between the pressurised fluid supply line and the one side of the piston.

In each case, the invention permits the controlled flow of fluid ejected from the cylinder at the one side of the piston as the operating member moves relative to the body in one direction, and the controlled flow of fluid into the cylinder at the one side of the piston as the operating member moves relative to the body in an opposite direction, so that no vibration, or at least only minimal vibration, is transmitted to the operating member and hence e.g. to the operator or the remainder of the mechanism.

Also, in each case, the cylinder at the other side of the piston of the operating member support structure, may communicate with a low pressure region so that any fluid passing from the one to the other side of the piston is relieved and does not present any resistance to piston movement in the cylinder.

In a preferred embodiment, the piston of the operating member support structure may move in its cylinder along the direction in which the impacting tool moves, which is preferably the same direction as the impacting piston moves in the body.

Where the percussion power tool apparatus is hand held, such as a breaker apparatus, in a first embodiment, the operating member may be a handle structure including a pair of handles, each supported by a respective piston received in a cylinder, the operating load acting to move the respective piston inwardly of its respective cylinder whilst such movement is resisted by fluid pressure in the respective cylinder at one side of the piston, whereby relative movement between each of the pistons and their respective cylinders is permitted in response to vibrations arising in the body and/or impacting tool, by controlled fluid flow between the one sides of the pistons and the pressurised fluid support system. However, the invention may be applied where the handle structure includes a single handle only, for one handed operation (such as a "D" handle), or a single handle for double handed operation.

In each case, the or each handle of the handle structure may be pivotally mounted to the body and may be attached to or merely supported on an operating load transmission element, e.g. a piston rod of the piston of the operating member support structure.

Where the or each handle is merely supported on a load transmission element, there may be provided a stop to restrict pivotal movement of the handle away from the body.

In another embodiment, the or each of the handles may be connected to the body by a linkage structure which constrains the handle to move relative to the body generally along the operating direction.

BRIEF DESCRIPTION OF THE DRAWINGS

Embodiments of the invention will now be described with reference to the accompanying drawings in which.

DESCRIPTION OF THE PREFERRED EMBODIMENTS

Figure 1:
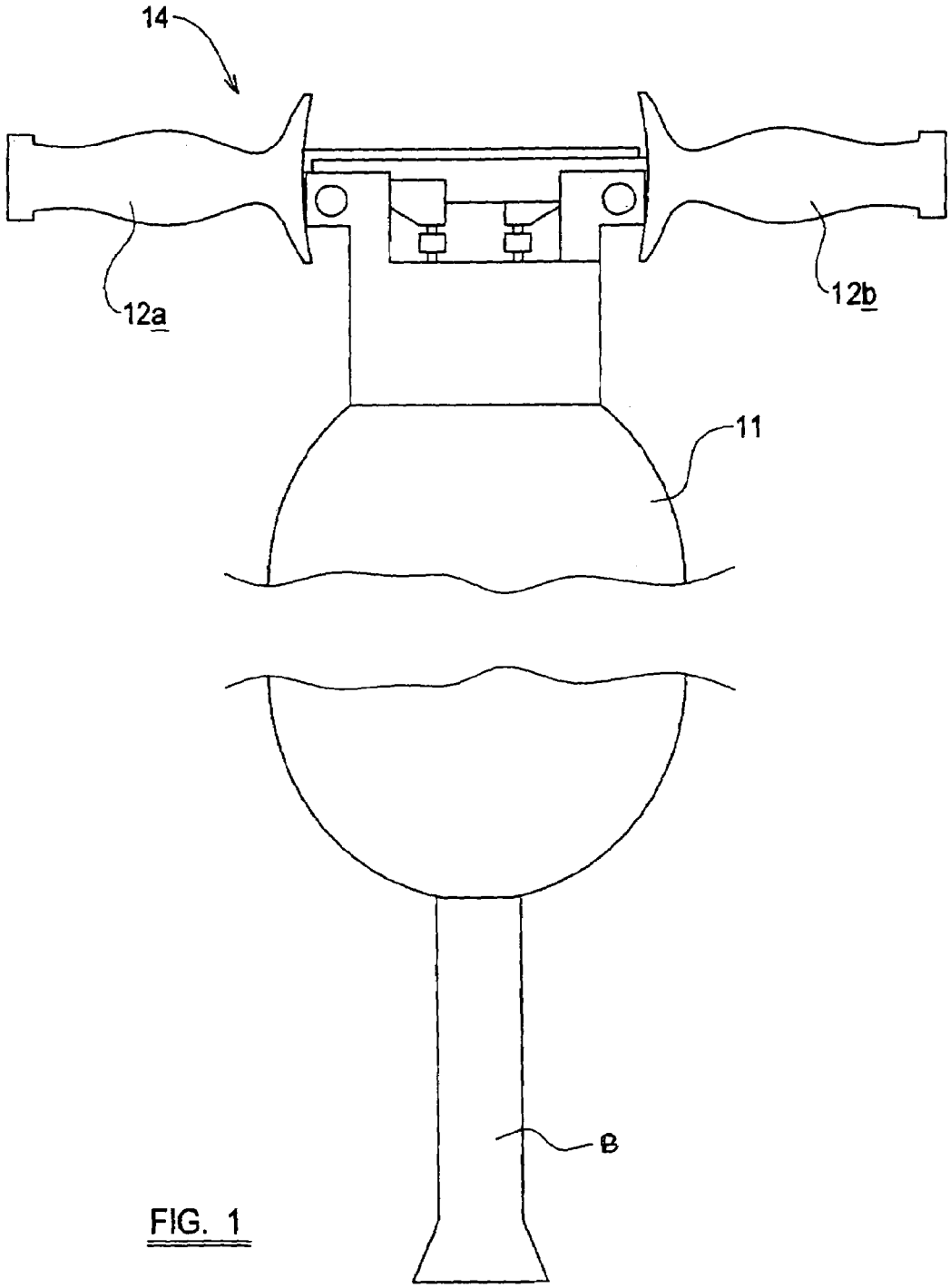
FIG. 1 is a purely illustrative view of a percussion power tool apparatus in accordance with the invention.

Referring to FIG. 1, a percussion power tool apparatus 10 includes a body 11 housing an impacting piston (not shown) which is moveable by hydraulic fluid pressure to impact an impacting tool B which is thus moved outwardly of the body 11 to impact a structure, such as a concrete or other ground structure, or a particle to be broken.

Upon being impacted, the impacting tool will be moved outwardly of the body and the body 11 will react by tending to move in an opposite direction, e.g. where the apparatus 10 is used in the orientation shown in FIG. 1 with the impacting tool extending downwardly, upon the impacting tool B being impacted, the body 11 will tend to move upwardly.

Conversely, as the impacting tool impacts the structure or particle, the impacting tool B will react and move upwardly again into the body 11. This cycle repeats several times each second. Thus in operation, the impacting tool B and the body 11 of the apparatus 10 will significantly vibrate.

Figure 2:
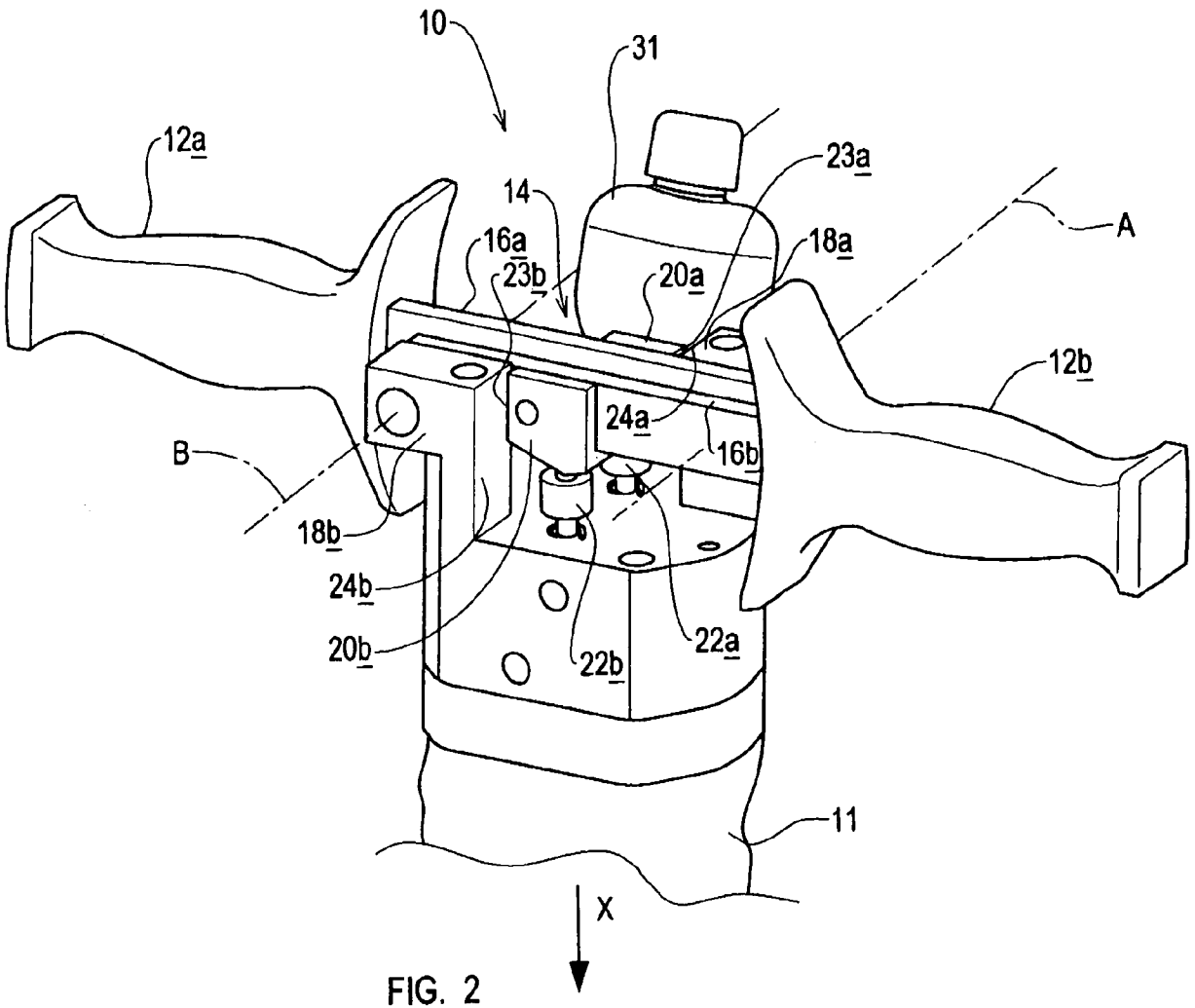
FIG. 2 is an illustrative perspective view of part of the percussion power tool apparatus of FIG. 1.

Referring now to FIG. 2, the apparatus 10 includes a support structure 14 which supports a pair of operating members being handles 16*a*, 16*b* by means of which an operator may manually hold, operate and manipulate the percussion power tool apparatus 10. Each handle 16*a*, 16*b* has provided on it, a tubular handle grip 12*a*, 12*b*, which may be received on or moulded about the respective handle 16*a*, 16*b* end, which grips 12*a*, 12*b* may provide some cushioning, but generally are ineffective at damping any vibrations which may be transmitted via the handles 16*a*, 16*b* to the operator's hands.

In the absence of any damping mechanism, such vibrations could cause vibration injury to an operator manipulating the apparatus 10 grasping the grips 12*a*, 12*b*.

In accordance with the invention, the handles 16*a*, 16*b* are supported relative to the body 11 by the handle support structure 14, which is best seen diagrammatically in FIG. 2. The handle support structure 14 includes for each handle 16*a*, 16*b*, a respective piston and cylinder arrangement 22*a*, 22*b*, the constructions of which for each handle 16*a*, 16*b*, are identical. The handle support structure 14 is effective to prevent the transmission of vibrations from the body 11 and impacting tool during the operating cycle of the percussion power tool apparatus 10, to the handles 16*a*, 16*b*.

In the example shown in FIG. 2, each of the handles 16*a*, 16*b* is pivotally attached to a respective mounting 18*a*, 18*b* of the body 11 for pivotal movement relative to the body 11 about a respective pivot axis A, B, the axes A, B extending laterally of an operating direction X along which the impacting tool and body 11 relatively move in operation.

Each handle 16*a*, 16*b* in this example, includes a rigidly fixed respective bearing part 20*a*, 20*b*, which bears on a load transmission element which includes a piston rod of a piston 26*a* of the respective piston and cylinder arrangement 22*a*, 22*b* of the operating member support structure 14.

The pivotal connections of the handles 16*a*, 16*b* to their mountings 18*a*, 18*b* enables the handles 16*a*, 16*b* to be pivoted upwardly in a direction away from the body 11 out of contact with the respective piston rod, at least when the percussion power tool apparatus 10 is not operational, but the bearing parts 20*a*, 20*b* have abutment surfaces 23*a*, 23*b* which engage with abutment surfaces 24*a*, 24*b* of the mountings 18*a*, 18*b* to stop and thus restrict the degree of upward handle 16*a*, 16*b* pivoting. Thus for example, the percussion power tool apparatus 10 may be lifted by the handles 16*a*, 16*b*.

In use though, an operator would exert an operating load on the apparatus 10 via the handles 16*a*, 16*b*, in the operating direction X.

Each piston and cylinder arrangement 22*a*, 22*b* includes a respective cylinder 25*a*, 25*b* in which there is provided the respective piston 26*a*, 26*b*.

Hydraulic fluid at one side 27*a*, 27*b* of each of the pistons 26*a*, 26*b*, communicates with a common fluid flow line 30 of a pressurised fluid support system 15, which resists the operating load exerted on the handles 16*a*, 16*b* by the operator, so that the operating load is transmitted to the body 11 of the apparatus.

Figure 3:
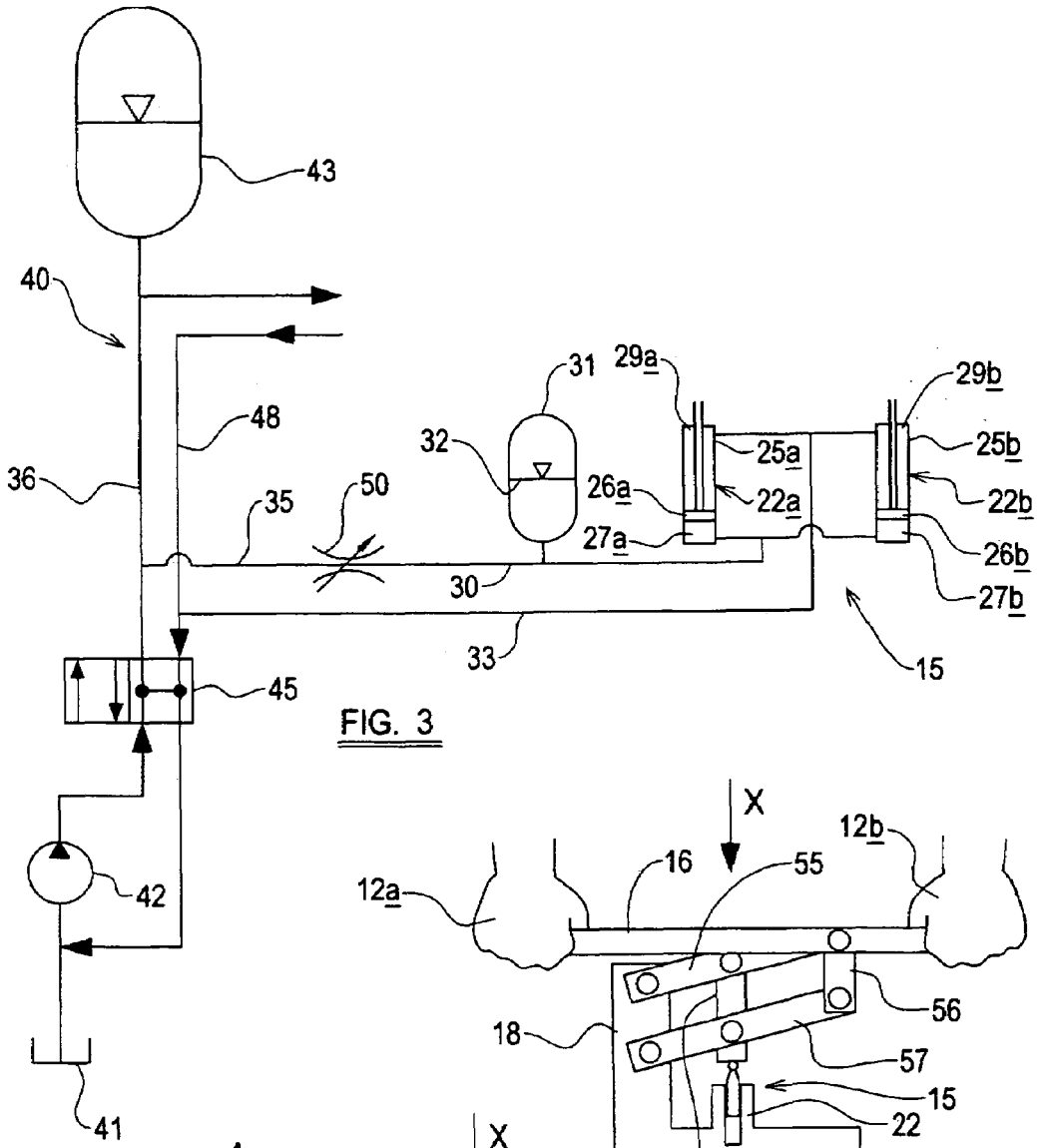
FIG. 3 is a diagram of a fluid circuit including an operating member support structure for the apparatus of FIG. 2.

In the example of FIG. 3, the pressurised fluid support system 15 includes an accumulator 31. Within the accumulator 31 pressurised fluid acts on a resilient damper, in this example a diaphragm of a gas spring 32, which provides the fluid pressure to resist the operating load applied by the operator. Additionally, the accumulator 31 controls the flow of fluid ejected from the cylinders 25*a*, 25*b* at the one sides 27*a*, 27*b* of the pistons 26*a*,26*b* as the handles 16*a*, 16*b* tend to move relatively towards the body 11 downwardly, as a result of vibrations arising in the body 11 and/or impacting tool, by resisting fluid flow towards the accumulator 31. Moreover, in response to relative movements of the handles 16*a*, 16*b* away from the body 11, in response to vibrations arising in the body 11 and impacting tool, the gas spring 32 acts to control the flow of fluid along the flow line 30 towards the one sides 27*a*, 27*b* of the pistons 26*a*, 26*b* within the cylinders 25*a*, 25*b* to replenish the cylinder spaces at the one sides 27*a*, 27*b* of the pistons 26*a*, 26*b*.

In this way, by controlling the flow of fluid to and from the one sides 27*a*, 27*b* of the pistons 26*a*, 26*b*, the handle support structure 14 presents substantially zero stiffness, thus providing for the maximum reduction of the transmission of vibrations from the body 11 to the handles 16*a*, 16*b*, arising during the operating cycle of the breaker apparatus, whilst not compromising the ability of the operator to have full control over the percussion power tool apparatus 10 as it is manipulated in use. Thus the operator grasping the handles 16*a*, 16*b* is effectively isolated from vibrations arising in the body 11 and/or impacting tool during the operating cycle of the apparatus 10.

The fluid in the pressurised fluid support system 15 is pressurised to an operating pressure for maximum effectiveness, the operating pressure being selected depending upon various parameters of the apparatus 10 such as the resilience of the gas spring 32 or other resilient damper of the accumulator 31, the mass of the percussion power tool apparatus, displacement of the piston and cylinder arrangements 22*a*, 22*b* etc., mass of the impacting piston, and hardness of the structure or particle to be broken.

Whereas the hydraulic fluid pressure within the pressurised fluid support system 15 could be primed by any desired means, in this example, as the percussion power tool apparatus 10 is operated by pressurised hydraulic fluid, the fluid system 15 provided by the accumulator 31 and the flow line 30 is pressurised by pressurised fluid provided for moving the impacting piston of the percussion power tool apparatus 10.

To achieve this the flow line 30 between the accumulator 31 and the one sides 27*a*, 27*b* of the pistons 26*a*, 26*b*, is connected to a high pressure hydraulic fluid supply line 36 of a hydraulic operating system 40 of the percussion power tool apparatus 10 which provides power to move the impacting piston of the apparatus 10, via a connecting line 35 in which there is provide a throttle 50.

Highly pressurised hydraulic fluid is provided to the hydraulic operating system 40 of the percussion power tool apparatus from a, usually external, reservoir 41, by a usually external pump 42, the operating system 40 including a fluid valve 45 for controlling the hydraulic fluid flow to operate the percussion power tool apparatus 10. The fluid valve 45 is shown in FIG. 2 only schematically and in an "off" position, where pumped hydraulic fluid is returned to the reservoir 41, and a residual pressure only is maintained in the operating system 40.

When the fluid valve 45 is moved to and "on" position, pumped pressurised fluid passes upstream of the valve 45 to the high pressure fluid supply line 36 for use in moving the impacting piston, and returns via a lower pressure return line 48 though the valve 45 and hence to the reservoir 41. It can be seen in this example that the hydraulic operating system 40 of the percussion power tool apparatus 10 includes its own accumulator 43 to provide an energy store for pressurising hydraulic fluid for use in moving the impacting piston.

In use, the impacting piston may be moved to strike the impacting tool up to several times per second, and thus there will be a pressure fluctuation in the fluid supply line 36 of the hydraulic fluid operating system 40 depending on the operating cycle of the apparatus 10.

The throttle 50 in the connecting line 35 connecting the high pressure fluid supply line 36 and the pressurised fluid support system 15 of the handle support structure 14 is in this example settable to achieve a desired degree of throttling. Preferably the throttle 50 is set so that a desired fluid pressure is established in the pressurised fluid support system 15 of the handle support structure 14 i.e. in this example, in the flow line 30 and accumulator 31 and hence in the cylinders 25*a*, 25*b* at the first sides 27*a*, 27*b* of the pistons 26*a*, 26*b*. However in another example, the throttle 50 may be actively controlled to vary the degree of throttling and hence the fluid pressure in the pressurised fluid support system 15, depending on one or more sensed parameters, such as the varying pressure in the hydraulic operating system 40 of the percussion power tool apparatus 10.

It will be appreciated, that upon start up of the apparatus 10, by virtue of the connecting line 35 from the hydraulic operating system 40 of the apparatus 10, to the pressurised fluid support system 15 of the handle support structure 14, the accumulator 31 of the pressurised fluid support system 15 will be charged, and that the pistons 26*a*, 26*b* may be moved upwardly in their cylinders 25*a*, 25*b* so that, by virtue of the piston rods being in contact with the bearing parts 18*a*, 18*b* of the handles 16*a*, 16*b*, the respective handles 16*a*, 16*b* are raised. When an operator exerts the operating load, this will lower the handles 16*a*, 16*b* to an operative position in which the operating load will balance the fluid pressure at the one sides 27*a*, 27*b* of the pistons 26*a*, 26*b*.

Upon shut down, the fluid pressure in the pressurised fluid support system 15 will leak away.

In the example shown, cylinder spaces 29*a*, 29*b* on other sides of the pistons 26*a*, 26*b* are connected via a common line 33 to the return line 48 of the hydraulic operating system 40 of the percussion power tool apparatus 10, so that in the event that any pressurised fluid leaks past the pistons 26*a*, 26*b*, such fluid may leak to a low pressure region (the reservoir 41) so that there is no resistance established to upward piston 26*a*, 26*b* movement.

Various modifications may be made without departing from the scope of the invention.

For example, in another embodiment, instead of a pair of handles 16*a* 16*b* for two handed operation, the apparatus may have a single handle, such as a "D" handle for one or two handed operations, or another single handle for one or two handed operations as desired.

Figure 6:
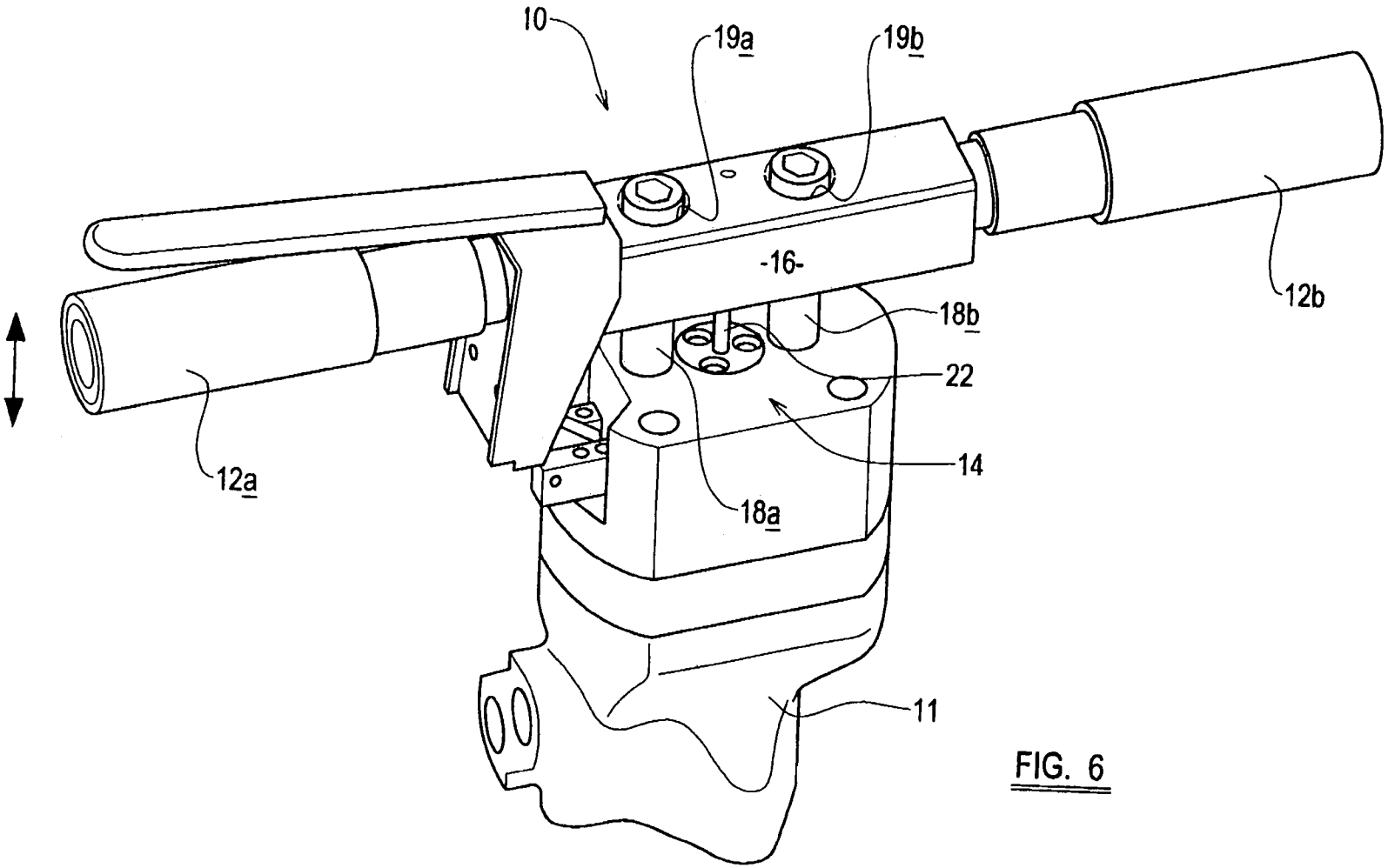
FIG. 6 is an illustrative view of part of still another percussion power tool apparatus in accordance with the invention.

In FIG. 6 there is shown a part of a power tool apparatus 10 similar to that shown and described with reference to FIG. 2, and similar parts are labelled with the same reference indices.

In FIG. 6 an operating member which is a single handle 16 is provided, the handle 16 being an elongate member having at each end, a respective handle grip 12*a*, 12*b* so that an operator may hold and support the power tool apparatus 10.

The handle 16 extends transversely to the body 11 and the operating direction X of the impacting tool, and is supported relative to the body 11, by a mounting provided by a pair of linear guides 18*a*, 18*b* which pass through respective openings 19*a*, 19*b* in the handle 16, each of which provides a linear bearing. Thus the handle 16 may move linearly in the operating direction X, towards and away from the body 11, guided by the linear guides 18*a*, 18*b*.

A support structure 14 supports the handle 16, and has a single piston an cylinder arrangement 22 provided between the linear guides 18*a*, 18*b*.

The support structure 14 permits an operator to exert a downward operating load on the apparatus 10 through the piston and cylinder arrangement 22, and thus the support structure 14 operates similarly to the support structure 14 of the FIG. 2 embodiment, not withstanding only a single piston and cylinder arrangement 22 is provided.

The linear bearings and/or the openings 19*a*, 19*b* in the handle 16, may permit an operator to lift the apparatus 10 by retaining the linear guides 18*a*, 18*b*. In FIG. 6 an operating trigger T is shown, which may be depressed and released by an operator to operate the apparatus 10.

Using the hydraulic operating system 40 of the apparatus 10 to prime the fluid pressure in the pressurised fluid support system 15 of the handle support structure 14 as described, is only exemplary. In another modification, the invention may be applied where the pressurised fluid support system 15 of the handle support structure 14 is entirely isolated from the hydraulic operating system of the apparatus 40 in which case an alternative priming means for pressurising the fluid pressure in the pressurised fluid support system 15 and thus in the accumulator 31 and at the one sides 27*a*, 27*b* of the pistons 26*a*, 26*b* would be required.

Further alternatively, where the fluid pressure in the operating system 40 of the apparatus 10 is suitable, and with suitable throttling, the pressurised fluid support system 15 of the handle support structure 14 may not include an accumulator 31 as shown. In this event, the flow of fluid to and from the one sides 27*a*, 27*b* of the pistons 26*a*, 26*b* may be controlled depending upon the varying pressure in the pressurised fluid supply line 36 of the hydraulic operating system 40.

In the example shown in FIG. 3 in which both the accumulator 31 is provided and the pressurised fluid support system 15 of the handle support structure 14 is connected to the high pressure fluid supply line 36, the control of fluid flow between the one sides 27*a*, 27*b* of the pistons 26*a*, 26*b* and the pressurised fluid support system in response to vibrations arising in the body 11 and/or impacting tool, may be predominantly by the action of the accumulator 31 or the varying pressure in the high pressure fluid supply line 36, or generally evenly by both.

Each piston and cylinder of the support structure, where a plurality of such are provided, could have its own pressurised fluid support system and accumulator 31 instead of sharing a common accumulator 31 as in the example described. Both pressurised fluid support systems may be connected individually to the hydraulic operating system 40 of the percussion power tool apparatus 10.

Figure 4:
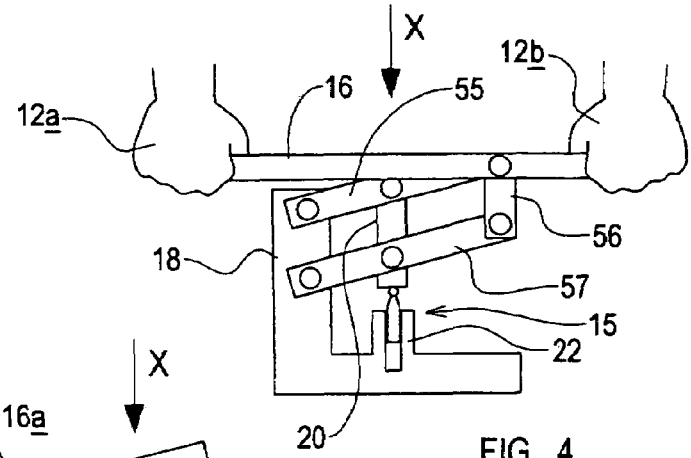
FIG. 4 is an illustrative view of part of another percussion power tool apparatus in accordance with the invention.
Figure 5:
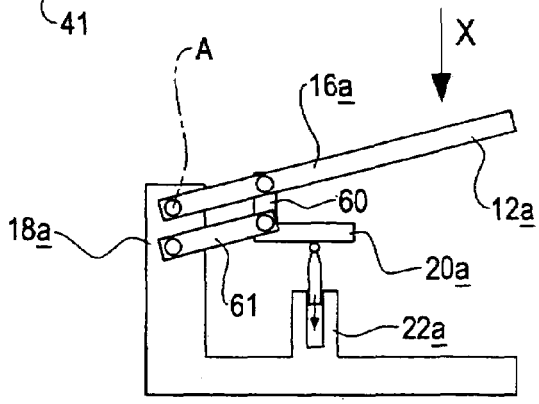
FIG. 5 is an illustrative view of part of yet another percussion power tool apparatus in accordance with the invention.

The geometry of the handle support structure 14 may be very different to that described and yet alternative examples are illustrated in FIGS. 4 and 5.

In FIG. 4 it can be seen that instead of a pair of handles 16*a*, 16*b*, like the FIG. 2 arrangement, or the single operating member 16 arrangement of FIG. 6, a single handle 16 for two handed operation is provided in which the handle 16 is mounted to a body mounting 18, via a linkage structure which in this example includes a first link 55 which is pivoted to both the mounting 18 and the handle 16, and a second link 56 which is pivoted to the handle 16 and a third link 57, which third link 57 is also pivoted to the mounting 18. A load transmission element 20 is pivotally connected to each of the first and third links 55, 57 and bears on a piston rod of a piston and cylinder arrangement 22, the arrangement being such that the handle 16 moves generally linearly in the operating direction X in which the impacting tool moves in use, relative to the body 11 of the apparatus 10 in response to vibrations arising, so there is no differential angular movement between the handle 16 and the load transmission element 20 and hence the piston and cylinder arrangement 22.

In FIG. 5, a single handle 16*a* of a pair of handles of a handle support structure 14 is shown, which handle 16*a* is pivotally mounted to a mounting 18*a* of the body 11, a load transmission element 20*a* of the handle support structure 14 being constrained to move linearly along the operating direction X in response to vibrations arising, by a linkage structure which includes a first link 60 to which the load transmission element 20*a* is rigidly connected, the first link 60 being pivotally connected to the handle 16*a* and to a second link 61 which is also pivotally connected to the mounting 18*a*.

The other handle of the pair (not shown) is mounted by a similar but oppositely handed structure, with each load transmission element 20*a* bearing on a single or respective piston and cylinder arrangement of the handle support structure 14.

Other geometries are possible including an arrangement in which the handle support structure 14 and body 11 have a sliding interface whereby the handle support structure 14 may move linearly relative to the body 11 during operation of the apparatus 10 in response to vibrations arising, along the direction of movement of the impacting piston, with the handle support structure acting to isolate the operator from vibrations arising which otherwise would be transmitted to the operator via the handles 16*a*, 16*b*.

Although the invention has been described in relation to a percussion power tool apparatus 14 which is a hand held breaker apparatus, the invention may be applied to other apparatus where it is required to isolate the percussion tool apparatus 10 from e.g. the remainder of a mechanism of which the apparatus 10 may be a part, and particularly from the means by which an operating load may be applied in an operating direction, to the apparatus 10, or at least to reduce the transmission of vibrations via an operating member mounting structure to an operating member which may be part of a mounting structure mounting the apparatus 10 relative to the remainder of the mechanism.

In another arrangement, the invention may be applied to a percussion power tool apparatus 10 which is not hydraulic fluid operated, but may be otherwise operated, e.g. by pneumatic fluid. The pressurised fluid support system 15 where hydraulic, would need to be isolated from the pneumatic fluid of the pneumatic operating system of the percussion power tool apparatus 10, or the pressurised fluid support system 15 may then be pneumatically actuated, in which case, an accumulator such as that described and shown at 31 in FIG. 2 of the drawings, may not be required to provide energy to pressurise the fluid.

The invention claimed is:

1. A percussion power tool apparatus including a body relative to which an impacting tool is moved by the action of hydraulic fluid pressure from a pressurized hydraulic fluid supply to effect an impacting operation, the apparatus further including an operating member by means of which an operating load is applied in an operating direction to the apparatus, a support structure for the operating member including a piston received in a cylinder, the operating load acting to move the piston inwardly of the cylinder whilst such movement is resisted by fluid pressure in the cylinder at one side of the piston, relative movement between the piston and the cylinder being permitted in response to vibrations arising in at least one of the body and the impacting tool, by controlling hydraulic fluid flow between the one side of the piston and a pressurised fluid support system.

2. An apparatus according to claim 1 wherein the apparatus is a hand operated apparatus and the operating member is a handle structure with at least one handle.

3. An apparatus according to claim 2 the operating member is a handle structure including a pair of handles, each supported by a respective piston received in a cylinder, the operating load acting to move the respective piston inwardly of its respective cylinder whilst such movement is resisted by fluid pressure in the respective cylinder at one side of the piston, whereby relative movement between each of the pistons and their respective cylinders is permitted in response to vibrations arising in the body or in response to vibrations arising in the impacting tool, by controlled fluid flow between the one sides of the pistons and the pressurised fluid support system.

4. An apparatus according to claim 3 wherein each handle of the handle structure is pivotally mounted to the body and is operatively coupled to an operating load transmission element of the operating member support structure.

5. An apparatus according to claim 3 wherein at least one of the handles is pivotally mounted to the body and is supported on a load transmission element, and wherein there is provided a stop to restrict pivotal movement of the handle away from the body.

6. An apparatus according to claim 5 wherein the at least one handle is connected to the body by a linkage structure which constrains the at least one handle to move relative to the body generally along the operating direction.

7. An apparatus according to claim 2 wherein the operating member is a handle structure with one handle for two handed operation of the apparatus, the handle being supported by a single piston received by a cylinder.

8. An apparatus according to claim 7 in which the handle receives a pair of linear guides which guide the handle to move relative to the body.

9. An apparatus according to claim 1 wherein the pressurised fluid support system includes a fluid accumulator with which the one side of the piston communicates.

10. An apparatus according to claim 9 wherein the accumulator is a chamber including a resilient member to which a gas pressure is applied.

11. An apparatus according to claim 1 wherein the pressure in the pressurised fluid support system varies in accordance with the operating cycle of the percussion tool apparatus, so that fluid flow from and to the one side of the piston is controlled by the varying pressure in the pressurised fluid support system, in accordance with the operating cycle.

12. An apparatus according to claim 1 wherein the percussion power tool apparatus is of the kind in which the impacting tool is moved outwardly of the body by being struck by an impacting piston moved by fluid pressure, the pressure of fluid at the one sidle of the piston of the operating member support structure varying with the fluid pressure applied to move the impacting piston.

13. An apparatus according to claim 12 wherein there is a feed line for pressurised fluid from a pressurised fluid supply line which provides power to move the impacting piston, to the pressurised fluid support system, the feed line including a throttle to restrict fluid flow between the pressurised fluid supply line and the pressurised fluid support system.

14. An apparatus according to claim 13 wherein the throttle is controllable to vary the extent of throttling depending upon one or more sensed parameters.

15. An apparatus according to claim 1 wherein the cylinder at the other side of the piston of the operating member support structure, communicates with a low pressure region so that any fluid passing from the one to the other side of the piston is relieved and does not present any resistance to piston movement in the cylinder.

16. An apparatus according to claim 1 wherein the piston of the operating member support structure is moveable in its cylinder along the direction in which the impacting tool moves.

17. A percussion power tool apparatus including a body relative to which an impacting tool is moved by the action of hydraulic fluid pressure from a pressurized hydraulic fluid supply to effect an impacting operation, the apparatus further including an operating member by means of which an operating load is applied in an operating direction to the apparatus, a support structure for the operating member including a piston received in a cylinder, the operating load acting to move the piston inwardly of the cylinder whilst such movement is resisted by fluid pressure in the cylinder at one side of the piston, relative movement between the piston and the cylinder being permitted in response to vibrations arising in at least one of the body and the impacting tool, by controlling hydraulic fluid flow between the one side of the piston and a pressurized fluid support system, the pressurized hydraulic fluid support including a hydraulic fluid accumulator with which the one side of the piston communicates, the accumulator being a chamber including a resilient member to which a gas pressure is applied, and the pressurized hydraulic fluid for the pressurized fluid support system being provided from the pressurized hydraulic fluid supply via a feed line.

* * * * *